US006768704B1

(12) United States Patent
Kawaguchi et al.

(10) Patent No.: US 6,768,704 B1
(45) Date of Patent: Jul. 27, 2004

(54) ELECTRONIC APPARATUS, EXTERNAL ADJUSTMENT DEVICE FOR THE SAME, AND ADJUSTING METHOD FOR THE SAME

(75) Inventors: Takashi Kawaguchi, Shiojiri (JP); Teruhiko Fujisawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/700,836

(22) PCT Filed: Mar. 30, 2000

(86) PCT No.: PCT/JP00/02031

§ 371 (c)(1),
(2), (4) Date: Nov. 17, 2000

(87) PCT Pub. No.: WO00/58794

PCT Pub. Date: Oct. 5, 2000

(30) Foreign Application Priority Data

Mar. 30, 1999 (JP) ..... 11-089911

(51) Int. Cl.[7] ..... G04B 1/00; G04C 11/08

(52) U.S. Cl. ..... 368/203; 358/53; 358/47; 318/17

(58) Field of Search ..... 368/1, 202, 9–11, 368/47, 46; 331/74, 158, 156; 318/17; 310/67 A

(56) References Cited

U.S. PATENT DOCUMENTS 3,978,650 A * 9/1976 Hashimoto et al. ..... 368/200
4,051,663 A 10/1977 Chihara et al.
RE31,402 E * 10/1983 Hashimoto et al. ..... 368/159
4,464,061 A * 8/1984 Kamiya ..... 368/202
4,473,303 A * 9/1984 Suzuki ..... 368/201
4,761,771 A * 8/1988 Moriya et al. ..... 368/202
5,255,247 A * 10/1993 Moriya ..... 368/87
5,459,436 A * 10/1995 Pucci et al. ..... 331/66
6,522,601 B2 * 2/2003 Sakuyama ..... 368/47
6,580,188 B2 * 6/2003 Katagiri et al. ..... 310/67 A
6,623,157 B1 * 9/2003 Fujisawa et al. ..... 368/187

FOREIGN PATENT DOCUMENTS

| | | |
|---|---|---|
| EP | 0 635 771 | 7/1997 |
| JP | 50-57670 | 5/1975 |
| JP | 54-89672 | 7/1979 |
| JP | 57-70417 | 4/1982 |
| JP | 3-46408 | 2/1991 |
| JP | 6-207992 | 7/1994 |
| JP | 6-235778 | 8/1994 |
| JP | 11-84028 | 3/1999 |
| WO | 94/16366 | 7/1994 |

* cited by examiner

*Primary Examiner*—David Martin
*Assistant Examiner*—Jeanne-Marguerite Goodwin

(57) ABSTRACT

When a frequency measurement unit measures the frequency of a temperature-sensing oscillation test signal and the frequency of a driving-pulse signal transmitted from an electronic apparatus via an coil electromagnetically coupled with a motor coil, a temperature-compensation data generation unit creates temperature-compensation data based on the frequency of the temperature-sensing oscillation test signal and the frequency of the driving-pulse signal. This temperature-compensation data is transmitted to an analog electronic timepiece via the coil. That is, a state of the analog electronic timepiece is measured in a non-contact manner and the temperature-compensation data obtained based on the measurement result is transmitted, whereby the analog electronic timepiece is adjusted in a state of being incorporated in an external casing.

10 Claims, 10 Drawing Sheets

[FIG.9]
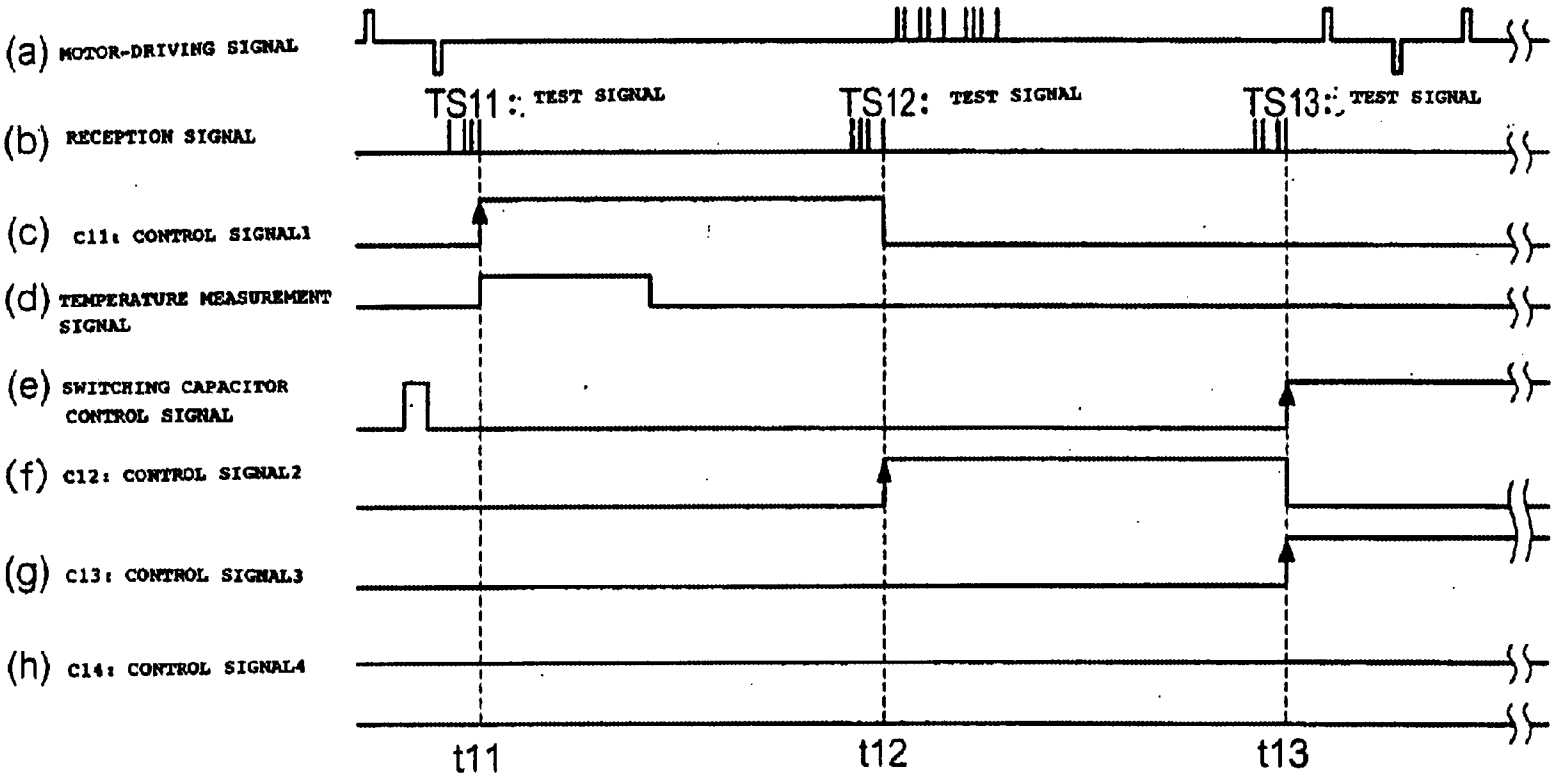

[FIG. 10]
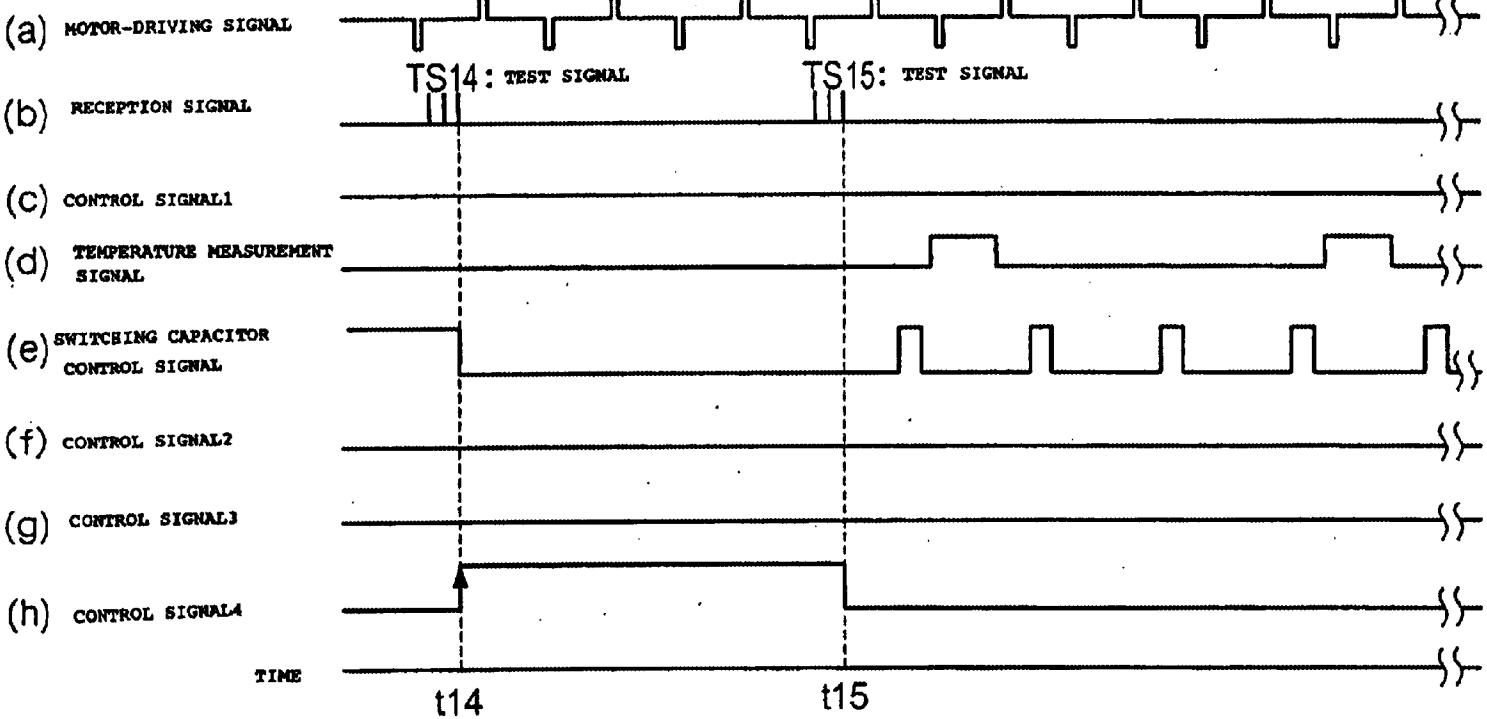

ELECTRONIC APPARATUS, EXTERNAL ADJUSTMENT DEVICE FOR THE SAME, AND ADJUSTING METHOD FOR THE SAME

TECHNICAL FIELD

The present invention relates to electronic apparatuses, external adjustment devices for the electronic apparatuses, and adjusting methods for the electronic apparatuses, and more particularly, relates to an electronic apparatus having a timing device, such as an analog timepiece or a digital timepiece, or various sensors incorporated therein, to an external adjustment device for this electronic apparatus, and to an adjusting method for the electronic apparatus.

BACKGROUND ART

In conventional analog timepieces, generally, an oscillation signal of a quartz oscillator is divided by a frequency divider and, based on the divided oscillation signal, driving of a driving motor causes hands to move. Furthermore, in order to precisely time regardless of variations in ambient temperature in its operation, analog timepieces provided with a temperature-compensation function have been developed. Such analog timepieces are provided with a temperature-sensing oscillator that changes the oscillation frequency in accordance with the temperature. The frequency-dividing ratio is set based on the oscillation frequency of the temperature-sensing oscillator.

However, the oscillation frequency of the quartz oscillator is varied in accordance with characteristics of each quartz oscillator or circuit components thereof. In addition, oscillation frequency characteristics with respect to the temperature of the temperature-sensing oscillator are not uniform.

Accordingly, in a circuit block of the analog timepiece provided with the temperature-compensation function or, in a state of a movement thereof, the oscillation frequency of the quartz oscillator and that of the temperature-sensing oscillator are measured, and then compensation data is written, based on the measurement result, in nonvolatile memory. The frequency-dividing ratio is adjusted based on the compensation data. In this case, the oscillation frequency is measured by contacting a measurement probe onto a predetermined test terminal.

Since measurement of the oscillation frequency requires the measurement probe, the above-described adjustment must be performed before the circuit block or the movement is incorporated in an external casing.

However, when the circuit block is incorporated in the movement or the movement is incorporated in the external casing, since stray capacitance or stress is changed, oscillation frequency characteristics of the quartz oscillator and those of the temperature-sensing oscillator are shifted before and after incorporation. Because of this, there are problems in that the adjustment becomes inaccurate and that the product yield of products is worsened.

The present invention is made in view of the foregoing circumstances. Objects of the present invention are to provide an electronic apparatus which is capable of securing adjustment precision when it is incorporated in the movement or the external casing and which capable of achieving improvement in the degree of freedom and adjustment speed, to provide an external adjustment device for the electronic apparatus, and to provide the adjusting method for the electronic apparatus.

SUMMARY OF THE INVENTION

A first aspect of the present invention is characterized in that there are provided: a reference signal generating unit for generating a reference signal; a temperature measuring unit for measuring the internal temperature of the apparatus and generating a temperature signal; a driving unit for generating a driving signal and outputting the driving signal to a motor coil of a unit to be driven; a receiving unit for receiving a signal transmitted from the outside via the motor coil; a detecting unit for detecting a type of the signal received by the receiving unit; and an examining unit for, based on the detection result of the detecting unit, outputting, via the motor coil, the temperature signal or digital data obtained by converting the temperature signal.

A second aspect of the present invention is characterized in that, in the first aspect, thereof there are provided: a storing unit for storing adjustment data used for adjusting the frequency of the reference signal in accordance with temperature; and an adjusting unit for adjusting the frequency of the reference signal in accordance with the internal temperature based on the temperature signal and the adjustment data.

A third aspect of the present invention is characterized in that, in the second aspect thereof, the signal transmitted from the outside includes an adjustment signal corresponding to the adjustment data.

A fourth aspect of the present invention is characterized in that, in the second aspect thereof, the driving unit generates the driving signal based on the output signal of the adjusting unit.

A fifth aspect of the present invention is characterized in that, in the first aspect thereof, the examining unit controls the driving unit so as to suspend driving of the motor coil while the temperature signal or the temperature digital data is output via the motor coil.

A sixth aspect of the present invention is characterized in that, in the first aspect thereof, the examining unit selectively outputs via the motor coil a signal corresponding to the frequency of the reference signal and the temperature signal based on the detection result of the detecting unit.

A seventh aspect of the present invention is characterized in that, in the sixth aspect thereof, the examining unit outputs the signal corresponding to the frequency of the reference signal as the driving signal from the motor coil by disabling an adjustment operation of the adjusting unit.

An eighth aspect of the present invention is characterized in that, in the first aspect thereof, the temperature measuring unit outputs, as the temperature signal, a temperature-sensing oscillation signal whose frequency varies in accordance with the internal temperature of the apparatus.

A ninth aspect of the present invention is characterized in that, in the first aspect thereof, the reference signal generating unit is provided with an oscillation circuit using a quartz oscillator; and the unit to be driven is an analog timing unit in which a timing operation is performed using analog hands.

A tenth aspect of the present invention is characterized in that, in a external adjustment device, having a motor coil, for adjusting an external electronic apparatus, there are provided: an coil for electromagnetically coupling with a motor coil; a receiving unit for receiving a temperature signal or the temperature digital data which is a signal via the coil from the electronic apparatus; a transmitting unit for transmitting a signal to the electronic apparatus via the coil; and an adjustment signal generating unit for generating an adjustment signal based on the temperature signal or the temperature digital data received by the receiving unit and the driving signal of the motor coil received by the receiving unit, and outputting the adjustment signal to the transmitting unit.

An eleventh aspect of the present invention is characterized in that, in the tenth aspect thereof, there is provided a signal generating unit for generating a first signal for instructing the output of the temperature signal or the output of the temperature digital data and a second signal for instructing disablement of an adjustment operation, and outputting them to the transmitting unit.

A twelfth of the present invention is characterized in that, in an external adjustment device for adjusting an external electronic apparatus comprising a motor coil outputting a temperature-sensing oscillation signal whose frequency varies in accordance with the internal temperature of the apparatus as a temperature signal or temperature digital data obtained by converting the temperature-sensing oscillation signal; and an adjusting unit for adjusting the frequency of a reference signal in accordance with the internal temperature based on either of the temperature signal and the temperature digital signal and the adjustment data, there are provided: a coil for electromagnetically coupling with the motor coil; a receiving unit for receiving, via the coil, the temperature signal or the temperature digital data which is a signal from the electronic apparatus; a transmitting unit for transmitting a signal to the electronic apparatus via the coil; and an adjustment signal generating unit for generating an adjustment signal based on the temperature signal or the temperature digital data received by the receiving unit and the driving signal of the motor coil received by the receiving unit and outputting the adjustment signal to the transmitting unit.

A thirteenth aspect of the present invention is characterized in that, in the twelfth aspect thereof, the adjustment signal generating unit generates the adjustment signal based on the driving signal received by the receiving unit while the adjustment operation of the adjusting unit is disabled.

A fourteenth aspect of the present invention is characterized in that, in an external adjustment device for adjusting an external electronic apparatus comprising a motor coil outputting a temperature-sensing oscillation signal whose frequency varies in accordance with the internal temperature of the apparatus as a temperature signal or temperature digital data obtained by converting the temperature-sensing oscillation signal; and a adjusting unit for adjusting the frequency of a reference signal in accordance with the internal temperature based on either of the temperature signal and the temperature digital signal and the adjustment data, there are provided: an coil for electromagnetically coupling with the motor coil; a receiving unit for receiving a signal via the coil from the electronic apparatus; a transmitting unit for transmitting a signal to the electronic apparatus via the coil; a frequency measuring unit for each measuring the frequency of the temperature signal received by the receiving unit, and the frequency of the driving signal received by the receiving unit while the adjustment operation of the adjusting unit is disabled; and an adjustment signal generating unit for generating an adjustment signal based on the measurement result of the frequency measuring unit and outputting the adjustment signal to the transmitting unit.

A fifteenth aspect of the present invention is characterized in that, in an adjusting method for adjusting an external electronic apparatus having a motor coil, there are provided: a first step of transmitting, to the electronic apparatus via the motor coil, a signal for instructing the output of the temperature signal corresponding to the temperature measured by the electronic apparatus or the output of the temperature digital signal obtained by converting the temperature signal; a second step of receiving the temperature signal or the temperature digital signal transmitted from the motor coil and sensing the temperature measured by the electronic apparatus; a third step of transmitting, to the electronic apparatus via the motor coil, a signal for instructing the start of disablement of an adjustment operation; a fourth step of receiving a driving signal transmitted from the motor coil and measuring the frequency of the driving signal; a fifth step of repeating the first step through the fourth step a plurality of times and generating an adjustment signal based on the sensed temperature and frequency; and a sixth step of transmitting the adjustment signal to the electronic apparatus via the motor coil.

A sixteenth aspect of the present invention is characterized in that, in an adjusting method for adjusting an external electronic apparatus having a motor coil, there are provided: a first step of transmitting a signal for instructing the start of disablement of an adjustment operation to the electronic apparatus via the motor coil; a second step of receiving a driving signal transmitted from the motor coil and measuring the frequency of the driving signal; a third step of transmitting, to the electronic apparatus via the motor coil, a signal for instructing the output of the temperature signal corresponding to the temperature measured by the electronic apparatus or the output of the temperature digital signal obtained by converting the temperature signal; a fourth step of receiving the temperature signal or the temperature digital signal transmitted from the motor coil and sensing the temperature measured by the temperature measuring unit; a fifth step of repeating the first step through the fourth step a plurality of times and generating an adjustment signal based on the sensed temperature and frequency; and a sixth step of transmitting the adjustment signal to the electronic apparatus via the motor coil.

BRIEF DESCRIPTION OF THE DRAWINGS

FIG. 9 consists of operation timing-charts of the second embodiment (Part 1).

FIG. 10 consists of operation timing-charts of the second embodiment (Part 2).

DETAILED DESCRIPTION OF THE PREFERRED EMBODIMENT

Next, embodiments of the present invention are described with reference to the drawings.

Initially, the first embodiment is described.

In this first embodiment, by way of an example, an analog electronic timepiece, which serves as an electronic apparatus, and an external adjustment device, which serves to adjust this electronic timepiece, are described. There is no intention to limit the present invention to these. The present invention can be applied to the electronic apparatus with a driving motor coil (equivalent to a driving coil for driving the hands of the analog electronic timepiece) for driving a unit to be driven and it can be applied to the external adjustment device for performing adjustment by communicating with the electronic timepiece apparatus via the driving motor coil.

Figure 1:
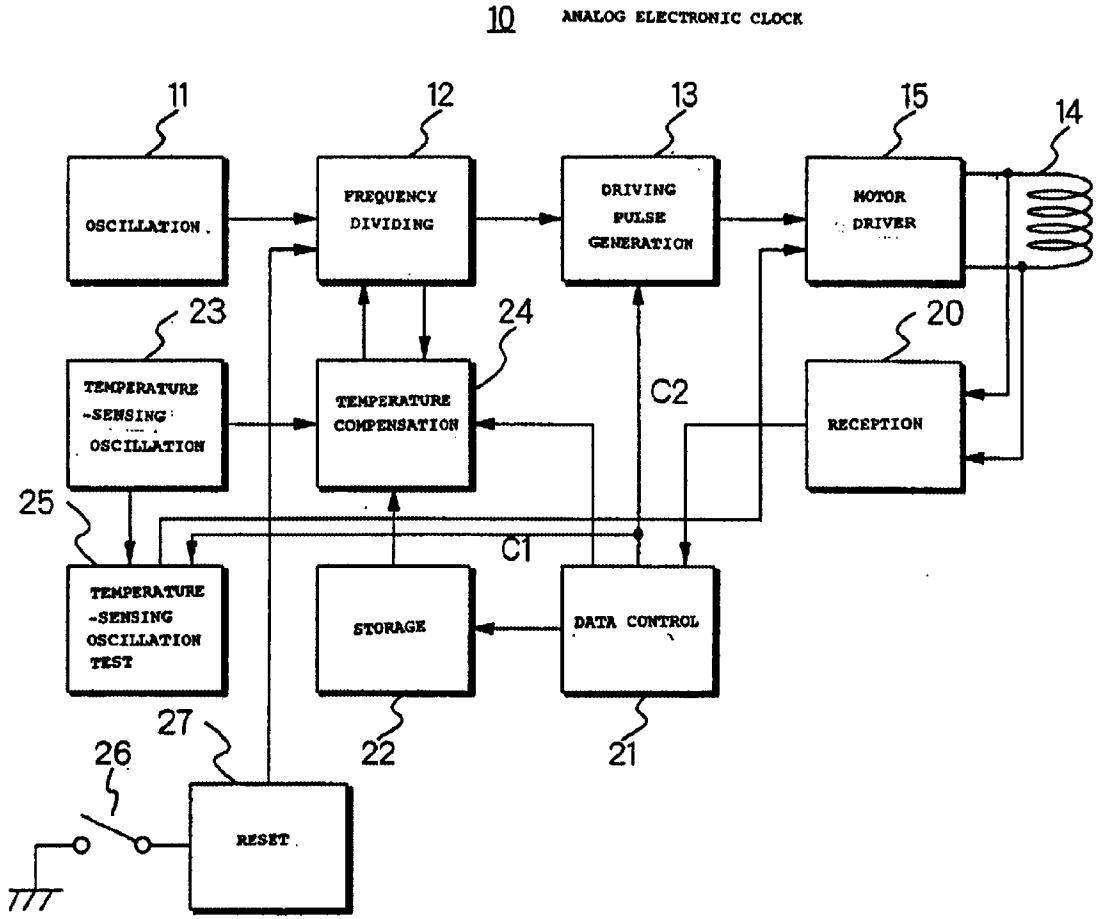
FIG. 1 is a general construction block diagram of an analog electronic timepiece according to a first embodiment.

First, the construction of the analog electronic timepiece is described. FIG. 1 shows a block diagram of the general construction of the analog electronic timepiece. As a basic construction for driving the hands, an analog electronic timepiece 10 is provided with an oscillation unit 11, a frequency-dividing unit 12, a driving-pulse generation unit 13, a motor coil 14, and a motor driver 15. The motor coil 14 is an coil of a driving motor incorporated in an analog timing unit for performing a timing operation using the analog hands.

The oscillation unit 11, which is constructed using a quartz oscillator, an oscillation circuit, and the like, generates a reference oscillation signal. Generally, resonance frequency characteristics of the quartz oscillator with respect to temperature can be approximated to a quadratic curve. Hence, the resonance frequency characteristics of the oscillation unit 11 with respect to temperature are given by a quadratic formula. The frequency-dividing unit 12, which is constructed using a frequency-dividing counter capable of setting the frequency-dividing ratio and the like, outputs a frequency-dividing oscillation signal by dividing the reference oscillation signal.

The driving-pulse generation unit 13 is controlled in accordance with a second control signal C2: in a case in which the logic level is the "L" level, a driving-pulse signal is generated based on the frequency-dividing oscillation signal (reference signal); in a case in which the logic level is the "H" level, generation of the driving-pulse signal is stopped. Hence, by appropriately setting the logic level of the second control signal C2, generation of the driving-pulse signal can be disabled or the disablement of generation can be cancelled.

The motor driver 15 drives the motor coil 14 for driving the hands based on the driving-pulse signal. Other than driving the hands, the motor coil 14 serves as an antenna for transmitting and receiving various data.

According to these constructions, since the driving-pulse signal is generated based on the reference oscillation signal, the frequency of the reference oscillation signal is proportional to the frequency of the driving-pulse signal. Accordingly, by measuring the frequency of the driving-pulse signal from the interval between pulses of the signal, the frequency of the reference oscillation signal can be measured based on the measurement result. By causing the frequency-dividing unit 12 to appropriately set the frequency-dividing ratio, time error (the amount of difference between the time indicated by the timepiece and the standard time; sec/day) can be adjusted.

Furthermore, as a construction for adjusting time error characteristics with respect to temperature, the analog timepiece 10 is provided with a reception unit 20, a storage unit 22, a temperature-sensing oscillation unit 23, a temperature-compensation unit 24, a temperature-sensing test unit 25, a crown switch (reset switch) 26, and a reset unit 27.

Initially, the reception unit 20 is constructed using a comparator, a shift register, and the like, and is connected to the motor coil 14. The unit 20 receives various data which is input due to electromagnetic coupling between the external coil and the motor coil 14 and outputs this as reception data by applying wave-form rectification thereto.

Next, a data control unit 21 is constructed using a counter and gates, and is provided at the subsequent stage of the reception unit 20. In the data control unit 21, various controls are performed based on the reception data. More specifically, the pulse pattern of the reception data is identified. Hence, the function of the detecting unit recited in the claims is performed by the data control unit 21. Based on the identification result, a first control signal C1 and the second control signal C2 which become active at the "H" level are generated. In addition, temperature-compensation data, which is a part of the reception data, is output to the storage unit 22.

The storage unit 22 is constructed using EEPROM and the like for storing the temperature-compensation data.

Next, the temperature-sensing oscillation unit 23 is constructed using a ring oscillator in which a driving current is varied in accordance with temperature, and the like. The unit 23 has frequency characteristics in which the oscillation frequency with respect to temperature is given by a linear formula, and generates a temperature-sensing oscillation signal.

Next, the temperature-compensation unit 24 is constructed using the counter and gates. The unit 24 controls the frequency-dividing unit 12 based on the compensation data and the oscillation frequency of the temperature-sensing oscillation signal stored in the storage unit 22. This allows time error characteristics with respect to temperature to be adjusted.

Next, the temperature-sensing test unit 25 is constructed using a ring oscillator in which the oscillation frequency is varied in accordance with temperature, and the like, and is arranged so as to output a temperature-sensing oscillation test signal indicating the oscillation frequency of the temperature-sensing oscillation signal during a period in which the first control signal C1 is valid. The temperature-sensing oscillation test unit 25 is provided with, for example, a frequency divider which frequency-divides the temperature-sensing oscillation signal by a fixed frequency-dividing ratio; a delay circuit which delays the output signal of the frequency divider; an exclusive logical OR circuit which generates exclusive logical addition of the output signal of the frequency divider and the output signal of the delay circuit; and a logical AND circuit in which the output signal of the exclusive logical OR circuit is supplied to one input terminal thereof and the first control signal C1 is supplied to the other input terminal thereof. According to this construction, during a period in which the first control signal C1 is maintained at the "H" level, pulses whose number corresponds to the oscillation frequency of the temperature-sensing oscillation signal can be obtained as a temperature-sensing oscillation test signal from the output terminal of the AND circuit. This temperature-sensing oscillation test signal is supplied to the motor driver 15. The pulse width of the test signal is set to be substantially shorter than that of a motor driving signal 60 that the test signal avoids affecting driving of the motor.

Next, the reset unit 27 detects an operation of the crown switch 26 by a user and performs reset processing of the frequency-dividing unit 12.

Figure 2:
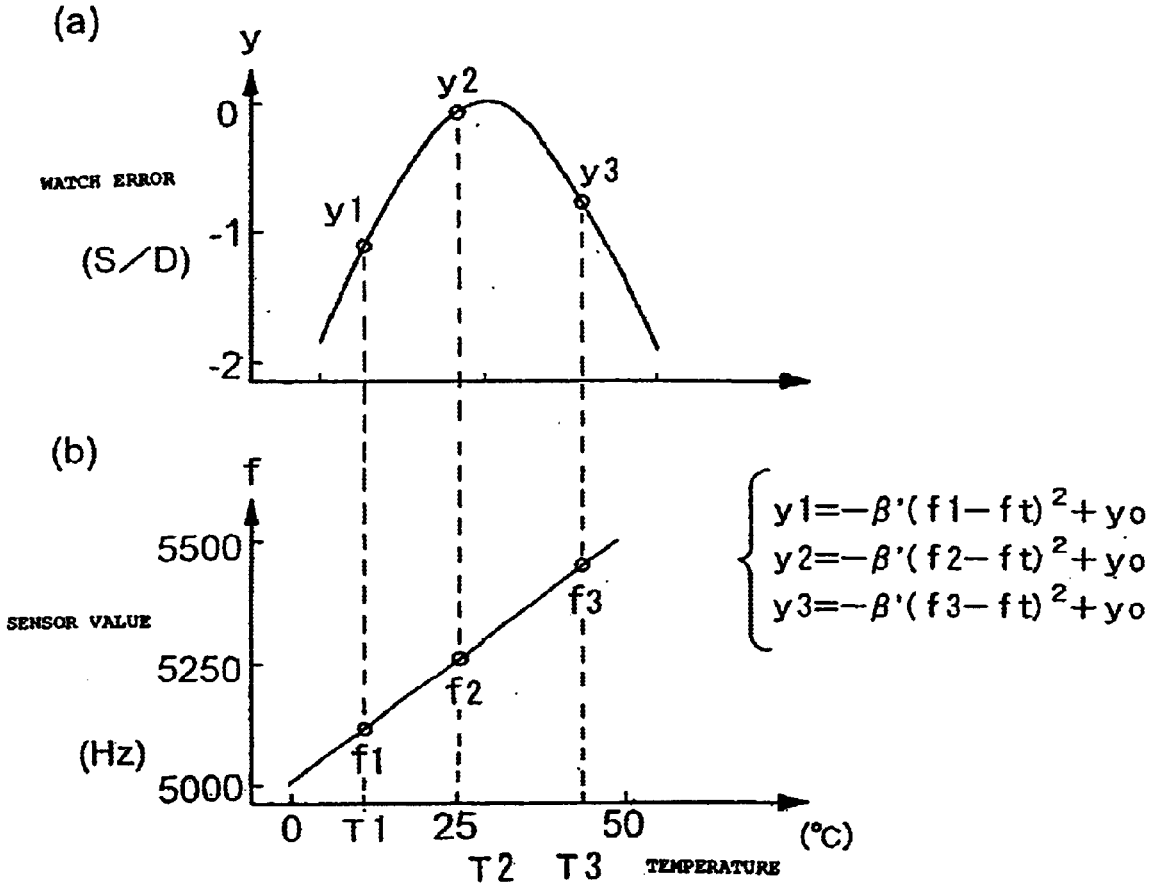
FIG. 2 consists of graphs illustrating adjustment of time error with respect to temperature.

Here, adjustment of time error with respect to temperature is described. FIG. 2(*a*) shows oscillation frequency characteristics of the oscillation unit 11 as time error characteristics with respect to temperature and FIG. 2(*b*) shows oscillation frequency characteristics of the temperature-sensing oscillation unit 23 with respect to temperature.

As shown in FIG. 2(*a*), oscillation frequency characteristics of the oscillation unit 11 are represented with a convex quadratic curve. Generally, this curve is given by the following expression (1):

$$y=-\beta\ (\theta-\theta t)^2+y0 \tag{1}$$

in which "y" represents time error in an operating temperature, "β" represents a gradient, "θt" represents the peak of temperature, and "y0" represents time error at the peak. Hence, by measuring these characteristics beforehand and making them known, time error y of the reference oscillation signal can be obtained based on the operating temperature and the known characteristics. Based on these, adjustment can be performed so that the time error y is equal to 0.

In the above-described analog electronic timepiece 10, the internal temperature of the apparatus is measured using the temperature-sensing oscillation unit 23. The frequency of the temperature-sensing oscillation signal is given by the following expression (2) in which, as shown in FIG. 2 (*b*), temperature is employed as a variable.

$$f=a\cdot\theta+f0 \tag{2}$$

in which "f" represents a frequency at an operating temperature, "a" represents a gradient, "θ" represents the operating temperature, and "f0" is a frequency at the intercept.

A following expression (3) is obtained from the expressions (1) and (2).

$$y32\ -\beta'\ (f-ft)^2+y0 \tag{3}$$

in which $\beta'=\beta\cdot a^2$ holds and ft is the frequency of the temperature-sensing oscillation signal corresponding to the temperature at the peak. In the expression (3), the frequency of the temperature-sensing oscillation signal can be known during the service of the analog electronic timepiece. Therefore, in order to compute the time error y during the service, β', ft, and y0 must be pre-computed.

Accordingly, in the present embodiment, by maintaining an isothermal state in the analog electronic timepiece 10 at three temperature points T1, T2, and T3, time errors y1, y2, and y3, respectively, are measured at the corresponding temperatures. Here, when the frequencies of the temperature-sensing oscillation signals of the temperatures are set as f1, f2, and f3, the following expressions (4) to (6) are given:

$$y1=-\beta'\ (f1-ft)^2+y0 \tag{4}$$

$$y2=-\beta'\ (f2-ft)^2+y0 \tag{5}$$

$$y3=-\beta'\ (f3-ft)^2+y0 \tag{6}$$

In the present embodiment, an after-mentioned external adjustment device 30 obtains β', ft, and y0 which are satisfied with the expressions (4) to (6) and sends these as the temperature-compensation data to the analog electronic timepiece 10. The analog electronic timepiece 10 stores the temperature-compensation data in the storage unit 22. After that, the temperature-compensation unit 24 computes the expression (3) based on the frequency f of the temperature-sensing oscillation signal and the temperature-compensation data (β', ft, y0) at the operating temperature of the timepiece 10 to obtain the time error y in its service, and adjusts the frequency-dividing ratio of the frequency-dividing unit 12 so that this becomes "0".

Accordingly, the analog electronic timepiece 10 can perform considerably precise timing regardless of variations in the ambient temperature.

Figure 3:
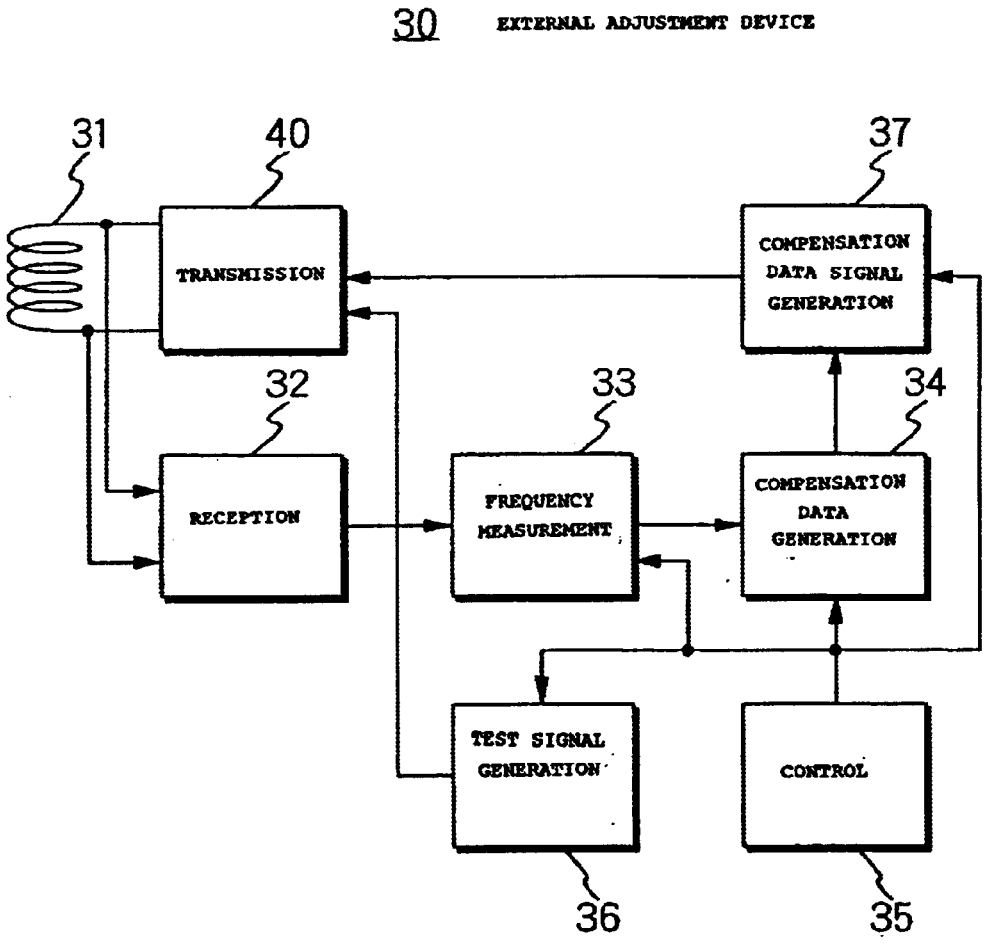
FIG. 3 is a general construction block diagram of an external adjustment device according to the first embodiment.

Next, the construction of the external adjustment device can be described. FIG. 3 shows a general construction block diagram of the external adjustment device.

The external adjustment device 30 is provided with an coil 31 which is electromagnetically coupled with the motor coil 14 of the analog electronic timepiece 10; a transmission unit 40, constructed using the shift register, an output buffer transistor, and the like, for exchanging data via the coil 31 with the analog electronic timepiece 10; a reception unit 32, constructed using the comparator, the shift register, and the like, for receiving via the coil 31; a frequency measurement unit 33, constructed using the counter and the like, for measuring the frequency; a temperature-compensation data generation unit 34, constructed using the counter, gates, and the like, for generating the temperature-compensation data; a control unit 35, constructed using the counter, gates, and the like, for controlling the overall external adjustment device 30; a test signal generation unit 36, constructed using the counter, gates, and the like, for generating a test signal; and a compensation data signal generation unit 37, constructed using the counter, gates, and the like, for generating a compensation data signal.

The frequency measurement unit 33 measures the frequency of the temperature-sensing oscillation test signal or the driving-pulse signal, and outputs this to the temperature-compensation data generation unit 34.

The temperature-compensation data generation unit 34 computes the frequency f of the temperature-sensing oscillation signal based on the frequency of the temperature-sensing oscillation test signal and computes the time error y based on the frequency of the driving-pulse signal. By performing this operation with respect to each of the three temperature points, (y1, f1), (y2, f2), and (y3, f3) shown in the expressions (4), (5), and (6), respectively, are obtained. The temperature-compensation data (β', ft, y0) is computed based on these. The compensation data signal generation unit 37 generates a temperature-compensation data signal used for transmission based on the generated temperature-compensation data.

The control unit 35 controls the overall external adjustment device 30. The test signal generation unit 36 generates first to fourth test signals TS1 to TS4 at a predetermined timing under the control of the control unit 35. The first to fourth test signals TS1 to TS4 are signals that direct the analog electronic timepiece 10 to switch its operating modes and their pulse patterns are known to the above-described data control unit 21.

Figure 4:
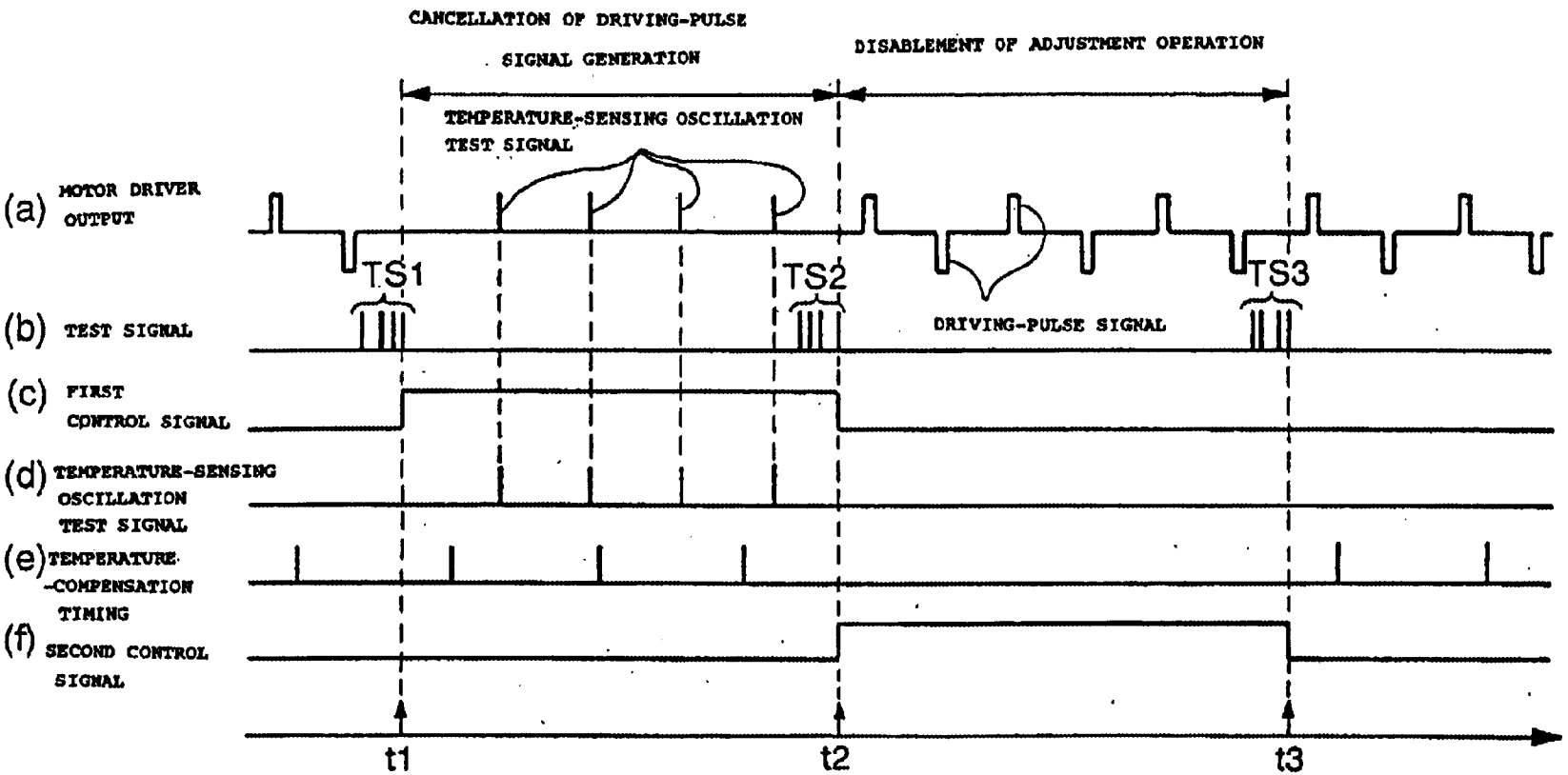
FIG. 4 consists of operation timing-charts of the first embodiment.
Figure 5:
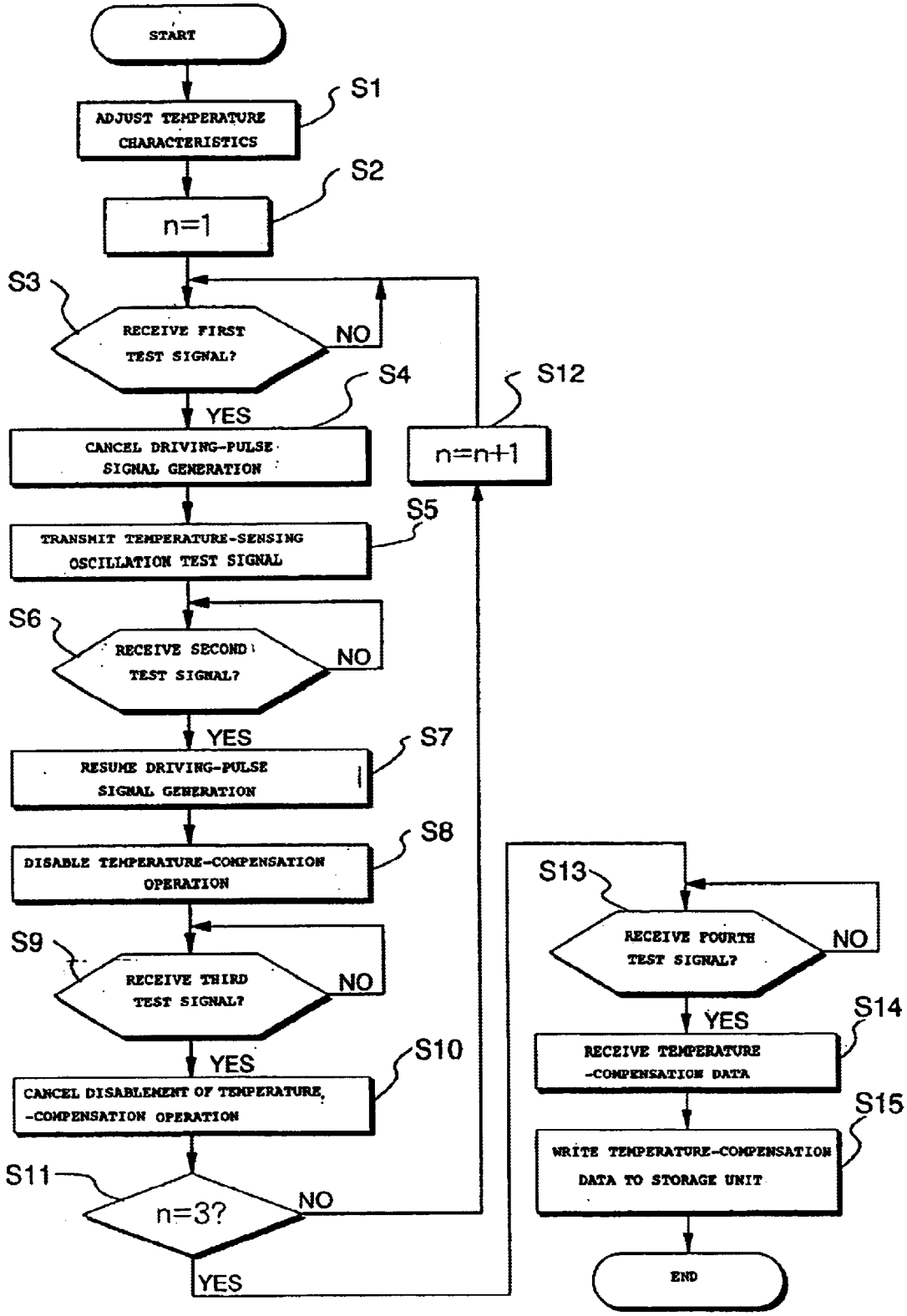
FIG. 5 is a flowchart of operation processing of the first embodiment.

Next, the operations of the first embodiment are described with reference to FIGS. 4 and 5. FIG. 4 shows an operation timing-chart and FIG. 5 shows an operation flowchart. A normal mode for causing the analog electronic timepiece 10 to normally operate, a measurement mode for measuring characteristics of the analog electronic timepiece 10 at the temperatures TI, T2 and T3 using the external adjustment device 30, and a writing mode for computing the temperature-compensation data based on the measurement results of three points and writing this to the analog electronic timepiece 10 are individually described as follows.

Initially, based on the oscillation frequency of the temperature-sensing oscillation unit 23 and temperature-sensing compensation data stored in the storage unit 22, the temperature-compensation unit 24 of the analog electronic timepiece 10 sets or resets a part of a frequency-dividing counter, which constitutes the frequency-dividing unit 12. Since this causes the frequency-dividing ratio to be adjusted, temperature characteristics of the oscillation unit 11 can be adjusted (step S1). The adjustment operation of this case is executed in accordance with pulse timing shown in FIG. 4(*e*). Although the adjustment operation is executed every two seconds in this example, the adjustment operation may be executed every 10 to 320 seconds.

Hereinafter, the analog electronic timepiece 10 and the external adjustment device 30 are disposed close to each other so as to capable of communicating data therebetween. A first-time measurement operation is started with the ambient temperature being maintained at the temperature T1.

When the first test signal TS1 is generated at time t1 by the test signal generation unit 36 under the control of the control unit 35 in the external adjustment device 30, the first test signal TS1 is transmitted to the analog electronic timepiece 10 by way of the transmission unit 40, the coil 31, the motor coil 14, and the reception unit 20 (see FIG. 4(*b*)). For management of the number of measuring operations, the control unit 35 initializes "1" to the storage value of a register (Step S2).

The data control unit 21 identifies the pulse pattern of reception data, determines whether the first test signal TS1 is received (Step S3), and repeats the determination until the first test signal TS1 is received.

Next, when the determination result turns out "Yes", that is, the data control unit 21 detects reception of the first test signal TS1, the data control unit 21 sets the "H" level to the logic level of the first control signal C1 at the time t1 (see FIG. 4(*c*)).

When the first control signal C1 having the "H" level is supplied to the driving-pulse generation unit 13, the driving-pulse generation unit 13 suspends generation of the driving-pulse signal (step S4). When the first control signal C1 having the "H" level is supplied to the temperature-sensing oscillation test unit 25, the temperature-sensing oscillation test unit 25 outputs, to the motor driver 15, the temperature-sensing oscillation signal obtained by dividing the temperature-sensing oscillation signal and differentiating this divided signal. The temperature-sensing oscillation test signal (see FIGS. 4(*a*) and (*d*)) is transmitted by way of the motor driver 15, the motor coil 14, the coil 31, and the reception unit 32 (step S5).

Hence, the function of the examining unit recited in the claims is performed, at least in part, by the temperature-sensing oscillation test unit 25.

Thus, during a period in which the temperature-sensing oscillation test signal is transmitted, the reason why generation of the driving-pulse signal is disabled is that the external adjustment device 30 cannot distinguish between pulses of the driving-pulse signal and pulses of the temperature-sensing oscillation test signal when they overlap. In this example, since the driving-pulse signal and the temperature-sensing oscillation test signal are transmitted exclusively, the external adjustment device 30 can positively detect the temperature-sensing oscillation test signal.

Subsequently, by measuring the pulse interval of the received temperature-sensing oscillation test signal under the control of the control unit 35, the frequency measurement unit 33 measures the frequency of the temperature-sensing oscillation test signal. In this case, the control unit 35 controls the frequency measurement unit 33 so that the number of pulses received during a period (from the time t1 to time t2) from generation of the first test signal TS1 to generation of the second test signal TS2 is counted. The period is a predetermined stretch of time. Hence, the frequency measurement unit 33 can measure the frequency of the temperature-sensing oscillation signal based on the measurement value.

Next, the test-signal generation unit 36 generates the second test signal TS2 at the time t2 under the control of the control unit 35 (see FIG. 4(*b*)). The second test signal TS2 is transmitted to the analog electronic timepiece 10 by way of the transmission unit 40, the coil 31, the motor coil 14, and the reception unit 20.

On the other hand, when detecting the first test signal TS1, in order to be ready for reception of the second test signal TS2, the data control unit 21 of the analog electronic timepiece 10 starts to determine whether the second test signal TS2 is received (step S6). The data control unit 21 identifies the pulse pattern of the reception data and repeats the determination until the second test signal TS2 is received.

Next, when the determination result turns out "Yes", that is, the data control unit 21 detects reception of the second test signal TS2 at the time t2, the data control unit 21 sets the "L" level to the logic level of the first control signal C1. When the first control signal C1 having the "L" level is supplied to the driving-pulse generation unit 13, the driving-pulse generation unit 13 resumes generation of the driving-pulse signal at the time t2 (step S7).

When detecting reception of the second test signal TS2, the data control unit 21 sets the "H" level to the logic level of the second control signal C2 (see FIG. 4(*f*)). When the second control signal C2 having the "H" level is supplied to the temperature-compensation unit 24, the temperature-compensation unit 24 suspends adjustment of the frequency-dividing ratio and controls the frequency-dividing unit 12 so that the frequency-dividing unit 12 is activated using a predetermined frequency-dividing ratio. Therefore, the temperature-compensation operation is disabled (step S8). This frequency-dividing ratio is known to the temperature-compensation data generation unit 34 of the external adjustment device 30.

The reason why the adjustment operation is disabled in this manner is that since the external adjustment device 30 cannot know the frequency-dividing ratio of the frequency-dividing unit 12 during the adjustment operation, the device 30 cannot compute the frequency of the reference oscillation signal even though receiving the driving-pulse signal. On the other hand, in this example, since the adjustment operation is disabled and the driving-pulse signal is generated by dividing the reference oscillation signal with a predetermined frequency-dividing ratio, the frequency of the reference oscillation signal can be measured by measuring the frequency of the driving-pulse signal using the external adjustment device 30.

Subsequently, when the driving-pulse signal is supplied to the motor driver 15, the driving motor is driven and the driving-pulse signal is transmitted by way of the motor driver 15, the motor coil 14, the coil 31, and the reception unit 32. The frequency measurement unit 33 measures the frequency of the driving-pulse signal. As described above, since the driving-pulse signal is generated based on the frequency-dividing oscillation signal obtained by dividing the reference oscillation signal with a predetermined frequency-dividing ratio, the frequency of the reference oscillation signal can be obtained based on the frequency of the driving-pulse signal at the temperature T1.

Next, the test signal generation unit 36 generates a third test signal TS3 at time t3 under the control of the control unit 35 (see FIG. 4(*b*)). The third test signal TS3 is transmitted to the analog electronic timepiece 40 by way of the transmission unit 40, the coil 31, the motor coil 14, and the reception unit 20.

When detecting the second test signal TS2, in order to be ready for reception of the third test signal TS3, the 94 data control unit 21 of the analog electronic timepiece 10 starts to determine whether the signal is received (step S9). The data control unit 21 repeats the determination until the pulse pattern of the reception data is identified and the third test signal TS3 is received.

Next, when the determination result turns out "Yes", that is, the data control unit 21 detects reception of the third test signal TS3, the data control unit 21 sets the "L" level to the logic level of the second control signal C2. When the second control signal C2 having the "L" level is supplied to the temperature-compensation unit 24, the temperature-compensation unit 24 resumes adjustment of the frequency-dividing ratio and controls the frequency-dividing unit 12 based on the temperature-compensation data. Hence, disablement of the temperature compensation operation is cancelled (step S10).

Subsequently, the process proceeds to step S11 in which the control unit 35 determines whether the storage value of the register is equal to "3" (step S11) and the process proceeds to after-mentioned writing mode when the storage value is equal to "3". On the other hand, when the storage value is not equal to "3", the storage value of the register is incremented by "1" (step S12). Processing at steps S3 through S12 is repeated until the storage value reaches "3". Specifically, when the first-time measurement operation is complete, the ambient temperature is changed from T1 to T2. At the time the ambient temperature is maintained at the isothermal state, a second-time measurement is performed. When the second-time measurement is complete, the ambient temperature is changed from T2 to T3. When the ambient temperature is maintained at the isothermal state, a third-time measurement is performed.

When the three-time measurements are complete in this manner, the temperature-compensation data generation unit 34 measures the frequency F1 of the reference oscillation signal and the frequency f1 of the temperature-sensing oscillation signal at the temperature T1, the frequency F2 of the reference oscillation signal and the frequency f2 of the temperature-sensing oscillation signal at the temperature T2, and the frequency F3 of the reference oscillation signal and the frequency f3 of the temperature-sensing oscillation signal at the temperature T3.

Next, the process proceeds to the writing mode. The temperature-compensation data generation unit 34 generates the temperature-compensation data based on (f1, F1), (f2, F2), and (f3, F3). The temperature-compensation data generation unit 34 initially computes the time errors y1, y2, and y3 corresponding to F1, F2, and F3, respectively.

Next, the coefficient β', the reference frequency ft, and the reference time error y0 which are satisfied with all of the above-described expressions (4) through (6), are computed and they are generated as the temperature-compensation data.

Thus, when the temperature-compensation data is generated, the test signal generation unit 36 generates a fourth test signal TS4 under the control of the control unit 35. The fourth test signal TS4 is output and, successively, the temperature-compensation data for transmission is output from the compensation data signal generation unit 37.

The fourth test signal TS4 and the temperature-compensation data are transmitted to the analog electronic timepiece 10 by way of the transmission unit 40, the coil 31, the motor coil 14, and the reception unit 20.

On the other hand, when detecting the third test signal TS3, in order to be ready for reception of the fourth test signal TS4, the data control unit 21 of the analog electronic timepiece 10 starts to determine whether the fourth test signal is received (step S13). The data control unit 21 identifies the pulse pattern of the reception data and repeats the determination until the fourth test signal TS4 is received.

Next, when the determination result turns out "Yes", that is, the data control unit 21 detects reception of the fourth test signal TS4, the data control unit 21 detects that its subsequent data is the temperature-compensation data, and then stands by.

After that, when the temperature-compensation data is received (step S14), the data control unit 21 writes the temperature-compensation data to the storage unit 22 (step S15). When this writing is completed, the data control unit 21 transits from the writing mode to the normal mode, which terminates the process.

As described above, according to the present embodiment, the following advantages are achieved.

According to this analog electronic timepiece 10, temperature compensation can be performed in an incorporated state in the external casing. This can drastically solve problems in that frequency characteristics of the reference oscillation signal are shifted due to stray capacitance which occurs when a circuit block is incorporated into a movement or when the movement is incorporated into the external casing. As a result, the considerably precision analog electronic timepiece 10 can be produced.

In a conventional analog electronic timepiece, temperature characteristics thereof are adjusted in the circuit block or in the movement state and the final inspection is experienced with the incorporated state. In a product failing in the inspection, the movement is taken out from the external casing and is readjusted. Readjustment repeats until the product passes the inspection. In contrast, in the above-described analog electronic timepiece 10, since temperature characteristics can be adjusted with the incorporated state in the external casing, the yield factor of the product can remarkably improve.

Since oscillation frequency characteristics with respect to the temperatures of the oscillation unit 11 and the temperature-sensing oscillation unit 23 can be measured in a non-contact manner, there is no need to provide a facility such as a positioning device for positioning a high-precision measurement probe, or a test terminal and a measurement probe. Accordingly, manufacturing cost can be reduced. In addition, since high-precision positioning is not required, adjustment time can be greatly reduced.

Next, the second embodiment of the present invention is described with reference to drawings.

Figure 6:
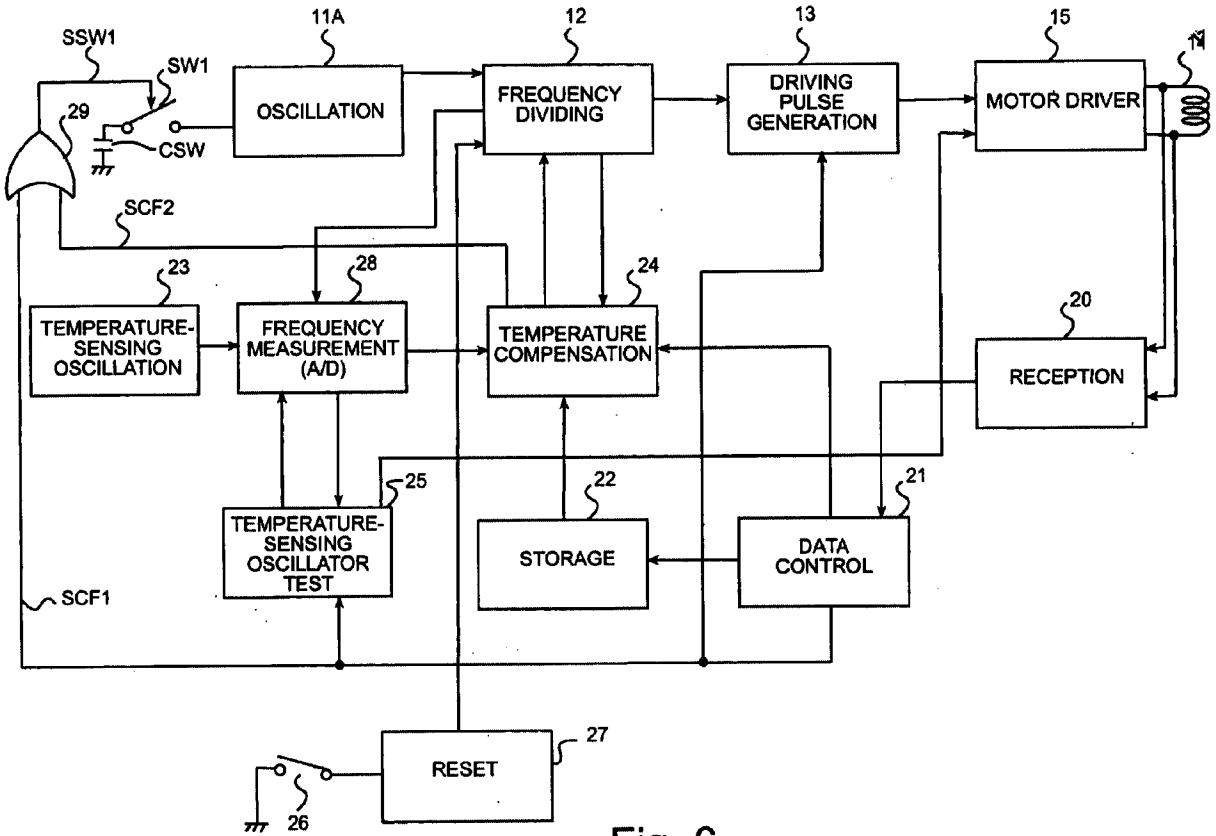
FIG. 6 is a general construction block diagram of an analog electronic timepiece according to a second embodiment.

FIG. 6 shows a general construction block diagram of the analog electronic timepiece according to the second embodiment.

In FIG. 6, elements that are identical to corresponding elements in the analog electronic timepiece 10 in FIG. 1 have the same reference numerals, and detailed description of identical elements is omitted.

Points in which an analog electronic timepiece 10A in this second embodiment is different from the analog electronic timepiece 10 are provisions of a frequency measurement unit 28 for measuring the frequency of the temperature-sensing oscillation signal output from the temperature-sensing transmission unit 23 and outputting digital oscillation frequency data having a value corresponding to the frequency of the temperature-sensing oscillation signal; an OR circuit 29 in which a first frequency control signal $S_{CF1}$, from the data control unit 21 and a second frequency control signal $S_{CF2}$ from the temperature-compensation unit 24 are input, and in which a switching capacitance control signal $S_{SW1}$ is output by logical-adding both inputs; a switching capacitor $C_{SW}$ for fine-adjusting the oscillation frequency of the oscillation unit 11A; and a switch SW1 for connecting the switching capacitor $C_{SW}$ to the oscillation unit 11A based on the switching capacitor control signal $S_{SW1}$.

Next, the construction of the external adjustment device according to the second embodiment is described.

Figure 7:
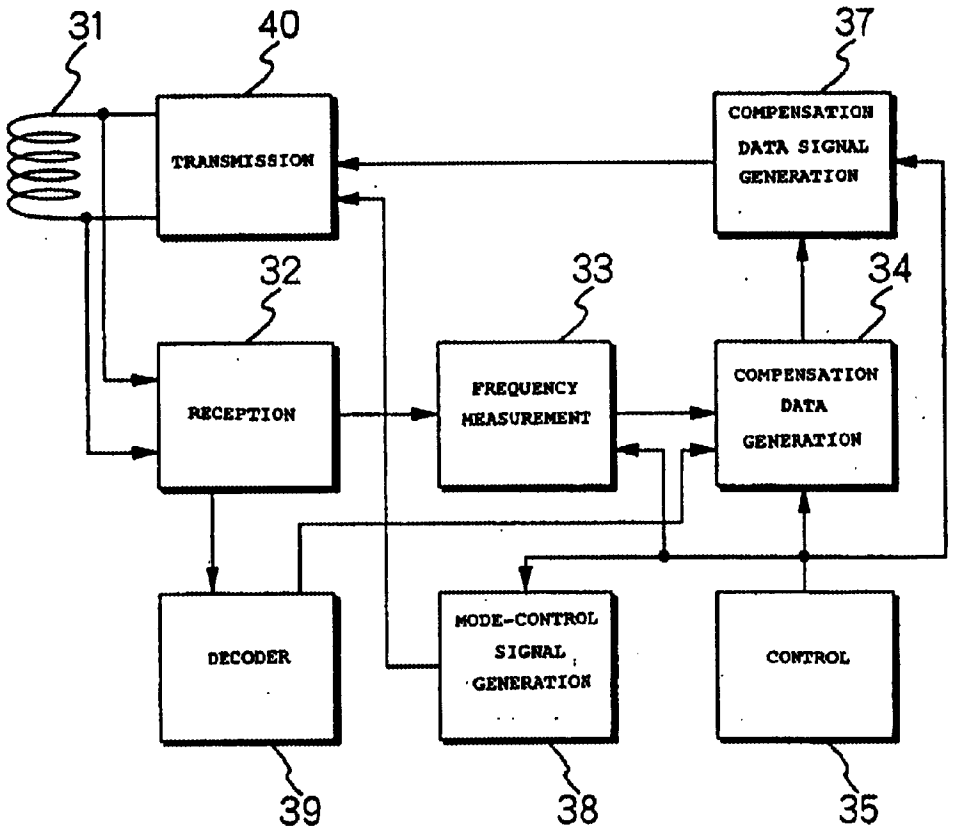
FIG. 7 is a general construction block diagram of an external adjustment device according to the second embodiment.

FIG. 7 shows a general construction block diagram of the external adjustment device.

Points in which the external adjustment device 30A is different from the external adjustment device 30 in FIG. 3 are provisions of a decoder unit 39 for decoding digital oscillation frequency data which is input via the reception unit 32; and mode control signal generation means 38 for generating a mode control signal for controlling an operating mode of the analog electronic timepiece 10A.

Figure 8:
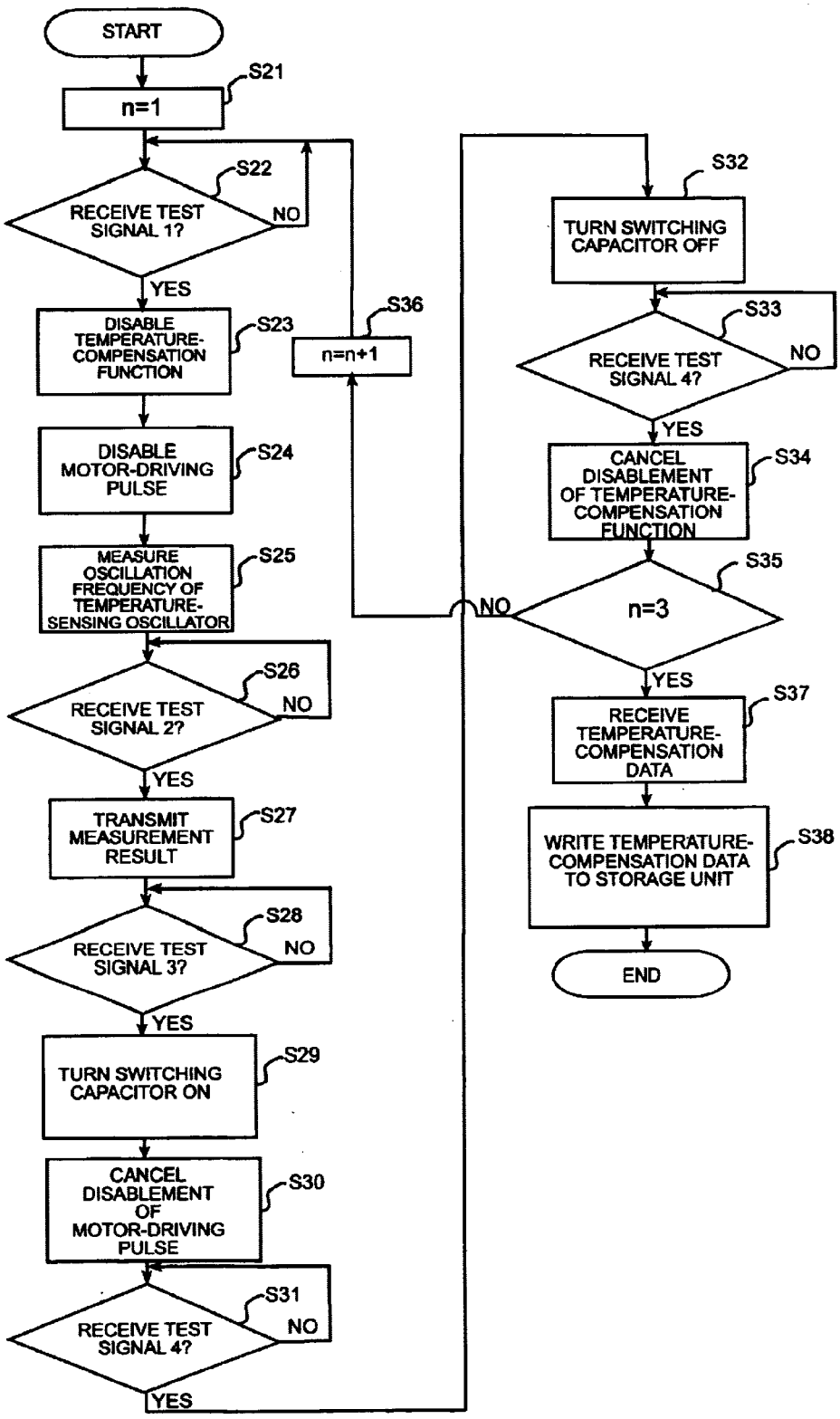
FIG. 8 is a flowchart of operation processing of the second embodiment.

Next, the operations of this second embodiment are described. Since the operation of the normal mode and that of the writing mode are the same as in the first embodiment, the detailed description thereof is omitted. The operation of the measurement mode is described with reference to FIGS. 8 to 10.

In the measurement mode of this second embodiment, the analog electronic timepiece 10A and the external adjustment device 30A are disposed closely so that data communication may be performed therebetween. A first-time measurement operation is started by maintaining the ambient temperature at T1.

In this case, for management of the number of measuring operations, the control unit 35 initializes the storage value of the register so that n=1 (step S21).

In the external adjustment device 30A, the mode control signal generation unit 38 generates a first test signal TS11 under the control of the control unit 35. The first test signal TS11 is transmitted to the analog electronic timepiece 10A by way of the transmission unit 40, the coil 31, the motor coil 14, and the reception unit 20 (see FIG. 9(*b*)).

The data control unit 21 identifies the pulse pattern of the reception data, determines whether the first test signal TS11 (denoted as a test signal 1 in the figure) is received (step S22), and repeats the determination until the first test signal TS11 is received.

Next, when the determination result turns out "Yes", that is, the data control unit 21 detects reception of the first test signal TS11 at time t11, the data control unit 21 sets the "H" level to the logic level of a first control signal C11 at the time t11(see FIG. 9(*c*)).

When the first control signal C11 having the "H" level is supplied to the temperature-compensation unit 24, the temperature-compensation unit 24 suspends adjustment of the frequency-dividing ratio and controls the frequency-dividing unit 12 so that the frequency-dividing unit 12 is activated in accordance with a predetermined frequency-dividing ratio. Hence, the temperature compensation operation is disabled (step S23). This frequency-dividing ratio is known to the temperature-compensation data generation unit 34 of the external adjustment device 30.

The reason why the adjustment operation is disabled in this manner is that since the external adjustment device 30 cannot know the frequency-dividing ratio of the frequency-dividing unit 12 during the adjustment operation, the reference clock of the digital oscillation frequency data considerably deviates. When receiving and decoding the digital oscillation frequency data, the external adjustment device 30A cannot precisely decodes, so that the frequency of the reference oscillation signal fails in measurement.

When the first control signal C1 having the "H" level is supplied to the driving pulse generation unit 13, the driving pulse generation unit 13 suspends generating the driving pulse signal (step S24).

When the first control signal C1 having "H" level is supplied to the temperature-sensing oscillation test unit 25, the temperature-sensing oscillation test unit 25 controls the frequency measurement unit 28 and the frequency measurement unit 28 measure the oscillation frequency of the temperature-sensing oscillator (step S25).

Subsequently, under the control of the control unit 35, the frequency measurement unit 28 measures the frequency of the temperature-sensing oscillation test signal by measuring the pulse interval of the received temperature-sensing oscillation test signal. In this case, during the period (from the time t11 to time t12) from when the first test signal TS11 is generated to when a second test signal TS12 is generated, the control unit 35 controls the frequency measurement unit 28 so that the frequency measurement unit 28 measures the frequency of the temperature-sensing oscillator 23.

Next, under the control of the control unit 35, the mode control signal generation unit 38 generates the second test signal TS12 at time t12 (see FIG. 9(*b*)).

The second test signal TS12 is transmitted to the analog electronic timepiece 10 by way of the transmission unit 40, the coil 31, the motor coil 14, and the reception unit 20.

On the other hand, when detecting the first test signal TS11, in order to be ready for the second test signal TS12 (denoted as a test signal 2 in the figure), the data control unit 21 of the analog electronic timepiece 10A starts to determine whether the second test signal is received (step S26). The data control unit 21 identifies the pulse pattern of the reception data and repeats the determination until the second test signal TS12 is received.

Next, when the determination result turns out "Yes", that is, the data control unit,21 detects reception of the second test signal TS12 at the time t12, the data control unit 21 sets the "L" level to the logic level of the first control signal C11.

When detecting reception of the second test signal TS12, the data control unit 21 sets the "H" level to the logic level of the second control signal C12 (see FIG. 9(*f*)).

This allows the frequency measurement unit 28 to transmit the digital oscillation frequency data as the measurement result via the temperature-sensing oscillator test unit 25, the motor driver 15, and the motor coil 14 (step S27).

On the other hand, the external adjustment device 30A causes the decoder unit 39 to decode the digital oscillation frequency data via the coil 31 and the reception unit 32. The compensation data generation unit 34 can know the frequency of the reference oscillation signal at the temperature T1.

Next, the test signal generation unit 38 generates a third test signal TS13 under the control of the control unit 35 at time t13 (see FIG. 9(*b*)). The third test signal TS3 is transmitted to the analog electronic timepiece 10A by way in of the transmission unit 40, the coil 31, the motor coil 14, and the reception unit 20.

On the other hand, when detecting the second test signal TS2, in order to be ready for reception of the third test signal TS13, the data control unit 21 of the analog electronic timepiece 10A starts to determine whether the third test signal is received. The data control unit 21 identifies the pulse pattern of the reception data and repeats the determination until the third test signal TS13 is received.

Next, the determination result turns out "Yes", that is, the data control unit 21 detects reception of the third test signal TS13, the data control unit 21 sets the "L" level to the logic level of the second control signal C12.

When detecting reception of the third test signal TS13, the data control unit 21 sets the "H" level to the logic level of the third control signal C13 (see FIG. 9(*g*)).

In consequence of this, the data control unit 21 sets the "H" level to the first frequency control signal $S_{CF1}$, so that the output of the OR circuit 29, which is the switching capacitor control signal $S_{SW1}$, becomes the "H" level.

As a result of this, the switch SW1 is turned on, which causes the switching capacitor $C_{SW}$ to be connected to the oscillation unit 11A (step S29). The oscillation frequency of the oscillation unit 11A decreases in accordance with the capacitance of the switching capacitor $C_{SW}$.

When the third control signal C13 having the "H" level is supplied to the driving pulse generation unit 13, disablement of driving pulse signal generation is cancelled. The driving pulse generation unit 13 resumes generation of the driving pulse signal (step S30).

On the other hand, when detecting the third test signal TS13, in order to be ready for reception of the fourth test signal TS14, the data control unit 21 of the analog electronic timepiece 10A starts to determine whether the fourth test signal is received (step S31). The data control unit 21 identifies the pulse pattern of the reception data and repeats the determination until the fourth test signal TS14 is received.

Next, when the determination result turns out "Yes", that is, the data control unit 21 detects reception of the fourth test signal TS14, the data control unit 21 sets the "H" level to the logic level of the fourth control signal C14 (see FIG. 10(*h*)).

In consequence of this, the data control unit 21 sets the "L" level to the first frequency control signal $S_{CF1}$, and sets the switching capacitance control signal $S_{SW1}$, which is the output of the OR circuit 29, to be the "L" level.

As a result, the switch SW1 is put into the off state, which causes the switching capacitance CSW to be non-conduction state with the oscillation unit 11A (step S32). The oscillation frequency of the oscillation unit 11A increases (restoration).

On the other hand, when detecting the fourth test signal TS14, in order to be ready for reception of the fourth test signal TS14, the data control unit 21 of the analog electronic timepiece 10A starts to determine whether the fourth test signal is received (step S33). The data control unit 21 identifies the pulse pattern of the reception data and repeats the determination until the fourth test signal TS14 is received.

Next, when the determination result at step S33 turns out "Yes", that is, the data control unit 21 detects reception of the fourth test signal TS14, the data control unit 21 sets the "L" level to the logic level of a fifth control signal C15 (see FIG. 10(*h*)).

This allows the temperature-compensation unit 24 to resume adjustment of the frequency-dividing ratio and to control the frequency-dividing unit 12 based on the temperature-compensation data. Accordingly, disablement of the temperature-compensation operation is cancelled (step S34).

Next, the control unit 35 determines whether the storage value of the register n="3" holds (step S35). When the storage value n="3" holds, the control unit 35 transits to the writing mode described in the first embodiment.

On the other hand, when the storage value n="3" does not hold, by setting the storage value of the register n=n+1 (step S35), processing at steps S22 through S35 is repeated until the storage value n="3" holds.

Specifically, when the first-time measurement operation is complete, the ambient temperature is changed from T1 to T2. At the time the ambient temperature is maintained at the isothermal state, the second-time measurement is performed. When the second-time measurement is complete, the ambient temperature is changed from T2 to T3. At the time the ambient temperature is maintained at the isothermal state, the third-time measurement is performed.

Thus, when the third-time measurement is complete, the temperature-compensation data generation unit 34 of the external adjustment device 30A measures the frequency F1 of the reference oscillation signal and the frequency f1 of the temperature-sensing oscillation signal at the temperature T1, the frequency F2 of the reference oscillation signal and the frequency f2 of the temperature-sensing oscillation signal at the temperature T2, and the frequency F3 of the reference oscillation signal and the frequency f3 of the temperature-sensing oscillation signal at the temperature T3. The temperature-compensation data generation unit 34 causes the compensation data signal generation unit 37 to generate corresponding compensation data signals. The signal is transmitted via the transmission unit 40 and the coil 31 to the analog electronic timepiece 10A.

This causes the analog electronic timepiece 10A to be in the writing mode. The data control unit receives the temperature-compensation data via the motor coil 14 and the reception unit 20 (step S37) and writes the temperature-compensation data to the storage unit (step S38).

As described above, according to this second embodiment, in addition to the advantages of the first embodiment, since the oscillation frequency of the temperature-sensing oscillator can be output as the digital data, communication having greater resistant to noises can be performed. Furthermore, since oscillation frequency measurement can be performed inside the analog electronic timepiece, higher matching with the oscillation frequency of the quartz oscillator can be obtained, which can improve the precision of measurement.

Since measurement is started by a signal (the first test signal) from the external adjustment device, frequency measurement of the temperature-sensing oscillator can be performed at an arbitrary timing. Since measurement data can be measured just before its transmission, influence due to variations in temperature is reduced and higher-precision measurement is performed.

In addition, even though a type in which the oscillation frequency can be minutely varied due to the switching capacitor is used as a quartz oscillator, measurement can be performed.

In the foregoing embodiments, the example is described in which the analog electronic timepiece serves as an electronic apparatus. The invention is not limited to this. For example, it can be applied to adjustment of various electronic apparatuses such as an electric toothbrush, an electric shaver, a cordless telephone, a portable telephone, a personal handy phone, a mobile personal computer, and a PDA (Personal Digital Assistant) as well as adjustment of sensors incorporated therein.

In the foregoing embodiments, the internal temperature of the apparatus is measured using the temperature-sensing oscillation unit 23 and the internal temperature information is output as the frequency of the temperature-sensing oscillation test signal or its digital data. However, the present invention is not limited to this. As long as the internal temperature of the apparatus is measured and is output as the temperature signal, the form of the signal is not important.

In the foregoing embodiments, in order to adjust the time error, the dividing-frequency ratio of the dividing-frequency unit 12 is arranged to be adjusted. However, the time error may be arranged to be adjusted by changing element constants of the oscillation unit 11. Alternatively, the time error may be arranged to be adjusted by combination of these. In short, any adjusting method may suffice as long as the frequency of the driving-pulse signal is adjusted based on the measured temperature and pre-stored temperature-compensation data.

In the foregoing embodiments, the operating modes of the analog electronic timepiece 10 are controlled from the outside by generating the first to the fourth test signals TS1 to TS4 at the test signal generation unit 36 and transmitting them to the analog electronic timepiece 10. However, the present invention is not limited to this. The external adjustment device 30 transmits the first test signal TS1 to the analog electronic timepiece 10 and then the data control unit 21 detects the first test signal TS1. After that, the output of the temperature-sensing oscillation test signal and the adjustment operation may be arranged to be disabled in accordance with a predetermined sequence.

In the foregoing embodiments, after generation of the driving-pulse signal is suspended (step S4) and the temperature-sensing oscillation test signal is transmitted (step S5), generation of the driving-pulse signal is resumed (step S7) and the temperature-compensation operation is disabled (step S8). However, the present invention is not limited to this. An arrangement is obviously acceptable in which precedently the temperature-compensation operation is disabled and then the frequency of the driving-pulse signal is measured; after that, generation of the driving-pulse signal is suspended, the temperature-sensing oscillation test signal is generated, and then the frequency of the test signal is measured.

In the foregoing embodiments, it is obviously acceptable that the data control unit 21 of the analog electronic timepiece 10 is constructed using a central processing unit (CPU) whereby the above-described various processing is executed using software. In addition, the motor coil 14 is not limited to the motor coil 14 for driving the hands. A motor coil of a generator motor may suffice for it.

In the foregoing embodiments, the external adjustment device 30 is arranged to be able to detect the frequency of the reference oscillation signal by externally outputting the driving pulse signal via the motor coil 14 with the temperature-compensation operation disabled. In short, since the external adjustment device 30 can only measure the frequency of the reference oscillation signal, the present invention is not limited to this. As long as a signal in accordance with the frequency of the reference oscillation signal is externally output via the motor coil 14, any construction may suffice. In order to differentiate the signal from the temperature-sensing oscillation test signal, it is preferable that both signals should be selectively output.

According to the foregoing embodiments, temperature characteristics of the electronic apparatus can be adjusted in a state close to that of the finished product, whereby adjustment precision thereof can be improved. Furthermore, adjustment time can be reduced and manufacturing cost thereof can be lowered.

What is claimed is:

1. An electronic apparatus, comprising:

a reference signal generator configured to generate a reference signal;

a temperature sensing unit configured to measure the internal temperature of the apparatus and to generate a temperature signal having a characteristic that varies in accordance with the internal temperature of the apparatus;

a drive unit configured to generate a drive signal and to output the drive signal to a motor coil of a unit to be driven;

a receiver configured to receive a signal transmitted from an external adjustment device via the motor coil;

a detecting unit configured to detect the type of the signal received by the receiver; and an examining unit configured to output a test signal via the motor coil to the external adjustment device, the test signal being indicative of the temperature-varying characteristic of the temperature signal, based on the detection result of the detecting unit.

2. An electronic apparatus according to claim 1, comprising:

a storage medium configured to store adjustment data used for adjusting the frequency of the reference signal in accordance with the internal temperature; and an adjusting unit configured to adjust the frequency of the reference signal in accordance with the internal temperature based on the temperature signal and the adjustment data.

3. An electronic apparatus according to claim 2, wherein the signal transmitted from the external adjustment device includes an adjustment signal corresponding to the adjustment data.

4. An electronic apparatus according to claim 2, wherein said drive unit is configured to generate the drive signal based on an output signal of the adjusting unit.

5. An electronic apparatus according to claim 2, wherein the examining unit is configured to selectively output a control signal to control the frequency of the reference signal and to control the frequency of the drive signal based on the detection result of the detecting unit.

6. An electronic apparatus according to claim 5, wherein the examining unit is configured to output the control signal by disabling an adjustment operation of the adjusting unit.

7. An electronic apparatus according to claim 1, wherein the examining unit is configured to control the drive unit so as to suspend driving of the motor coil while the test signal is being output.

8. An electronic apparatus according to claim 1, wherein the temperature signal generated by the temperature sensing unit is a temperature-sensing oscillation signal whose frequency varies in accordance with the internal temperature of the apparatus.

9. An electronic apparatus according to claim 1, wherein:

the reference signal generator includes an oscillation circuit using a quartz oscillator; and the unit to be driven is an analog timing unit in which a timing operation is performed using analog hands.

10. A method of operating an electronic apparatus, comprising:

generating a reference signal;

measuring the internal temperature of the apparatus and generating a temperature signal having a characteristic that varies in accordance with the internal temperature of the apparatus;

generating a drive signal and outputting the drive signal to a motor coil of a unit to be driven;

receiving a signal transmitted from an external adjustment device via the motor coil;

detecting the type of the signal received by the receiver; and outputting a test signal via the motor coil to the external adjustment device, the test signal being indicative of the temperature-varying characteristic of the temperature signal, based on the result of the step of detecting the type of the signal received by the receiver.

* * * * *